US011747060B2

(12) United States Patent
Bouquet

(10) Patent No.: US 11,747,060 B2
(45) Date of Patent: Sep. 5, 2023

(54) VAPOR COMPRESSION SYSTEM AND METHOD FOR OPERATING HEAT EXCHANGER

(71) Applicant: Carrier Corporation, Palm Beach Gardens, FL (US)

(72) Inventor: Xavier-Pierre Nicolas Bouquet, Chatillon-la-Palud (FR)

(73) Assignee: Carrier Corporation, Palm Beach Gardens, FL (US)

( * ) Notice: Subject to any disclaimer, the term of this patent is extended or adjusted under 35 U.S.C. 154(b) by 91 days.

(21) Appl. No.: 17/303,872

(22) Filed: Jun. 9, 2021

(65) Prior Publication Data

US 2021/0396434 A1 Dec. 23, 2021

Related U.S. Application Data

(60) Provisional application No. 62/705,236, filed on Jun. 17, 2020.

(51) Int. Cl.

| | |
|---|---|
| ***F25B 39/02*** | (2006.01) |
| ***F25B 39/04*** | (2006.01) |
| ***F28D 21/00*** | (2006.01) |

(52) U.S. Cl.

CPC ..... *F25B 39/028* (2013.01); *F25B 39/04* (2013.01); *F28D 21/00* (2013.01); *F25B 2341/06* (2013.01); *F28D 2021/0071* (2013.01)

(58) Field of Classification Search

CPC .... F25B 39/028; F25B 39/04; F25B 2341/06; F28D 21/00; F28D 2021/0071

See application file for complete search history.

(56) References Cited

U.S. PATENT DOCUMENTS

| | | | |
|---|---|---|---|
| 6,868,695 B1 | 3/2005 | Dingel et al. | |
| 8,739,562 B2 | 6/2014 | Kohler et al. | |

(Continued)

FOREIGN PATENT DOCUMENTS

| | | | |
|---|---|---|---|
| CN | 109579191 A * 12/2018 | ..... | F24F 11/64 |
| CN | 109579191 B * 12/2018 | ..... | F24F 11/64 |

(Continued)

OTHER PUBLICATIONS

Pdf is translation of foreign reference (Year: 2018).*

(Continued)

*Primary Examiner* — Henry T Crenshaw
*Assistant Examiner* — Kamran Tavakoldavani

(57) ABSTRACT

A vapor compression method and system including: a compressor configured to circulate a working fluid and operate at a plurality of operating conditions; an evaporator in fluid communication with the compressor, the evaporator heat exchanger comprising: a shell configured to allow the working fluid to flow therethrough; a plurality of parallel-spaced tubes disposed within the shell, the plurality of parallel spaced tubes configured to allow a heat transfer fluid to flow therethrough; and at least one baffle operably coupled to the plurality of parallel-spaced tubes, the at least one baffle configured to divide the shell into at least two chambers; an expansion valve assembly in fluid communication with the evaporator; and a control device operably coupled to the compressor and the expansion valve assembly, the control device configured to operate the valve assembly based at least in part on the plurality of operating conditions.

18 Claims, 3 Drawing Sheets

(56) References Cited

U.S. PATENT DOCUMENTS

| | | | | |
|---|---|---|---|---|
| 9,151,541 | B2 | 10/2015 | Jagusztyn | |
| 2012/0111040 | A1 | 5/2012 | Kohler et al. | |
| 2014/0026608 | A1 | 1/2014 | Manzo et al. | |
| 2015/0040607 | A1* | 2/2015 | Miglio | F25B 1/00 62/498 |
| 2018/0187932 | A1 | 7/2018 | Miyoshi et al. | |
| 2019/0017712 | A1* | 1/2019 | Zhan | F24F 3/065 |

FOREIGN PATENT DOCUMENTS

| | | | |
|---|---|---|---|
| CN | 109579191 | A | 4/2019 |
| KR | 2011004147 | A | 7/2009 |

OTHER PUBLICATIONS

Pdf is translation of foreign reference CN-109579191A (Year: 2018).*

EP Application No. 21180069.3, Extended Search Report, dated Mar. 21, 2022, 13 pages.

* cited by examiner

VAPOR COMPRESSION SYSTEM AND METHOD FOR OPERATING HEAT EXCHANGER

CROSS REFERENCE TO A RELATED APPLICATION

The application claims the benefit of U.S. Provisional Application No. 62/705,236 filed Jun. 17, 2020, the contents of which are hereby incorporated in their entirety.

BACKGROUND

This invention relates generally to vapor compression systems, and more particularly to a heat absorption heat exchanger having an internal baffle system and an external expansion valve assembly.

Vapor compression systems for cooling water commonly referred to as "chillers" are widely used in air conditioning applications. Such systems have large capacities, usually 100 tons or greater, and are used to cool large structures such as office buildings, large stores and ships. In general, a vapor compression system employing a chiller includes a closed chilled water flow loop that circulates water from a heat absorption heat exchanger (e.g., an evaporator) to a number of water-to-air heat exchangers located in the space or spaces to be cooled. Another application for a chiller is as a process cooler for liquids in industrial applications where chilled water or other fluids from the chiller can be pumped through process or laboratory equipment to cool the equipment. In recent years, variable speed drive (VSD) technology has been developed to increase efficiencies of vapor compression chillers. Such chillers may be referred to as "variable speed chillers" and are able to efficiently match cooling demands of a system in which they are deployed.

In general, variable speed chillers use a working fluid (e.g., refrigerant) in a closed loop that flows from a compressor, to a heat rejection heat exchanger such as a condenser, to an expansion device, to a heat absorption heat exchanger and back to the compressor. In a cooling cycle, refrigerant vapor is generally compressed by the compressor, and then condensed to liquid refrigerant in the condenser. The liquid refrigerant can then be directed through the expansion device to reduce the pressure and lower the temperature of the refrigerant, generally changing the liquid refrigerant to a liquid/vapor refrigerant mixture (two-phase or biphasic refrigerant mixture). The refrigerant is directed into the evaporator to exchange heat with a heat transfer fluid, such as water or any other appropriate coolant fluid moving through the evaporator. The refrigerant can be vaporized in the evaporator, and the refrigerant vapor can then be returned to the compressor to repeat the refrigerant cycle.

Some variable speed chiller systems use a heat absorption heat exchanger such as a shell-and-tube type evaporator where a heat exchange occurs between the refrigerant, and a fluid to be cooled, such as water. A shell-and-tube evaporator, sometimes referred to as a "flooded" evaporator, generally includes an outer shell in which are enclosed a plurality of tubes, termed a "tube bundle" through which water flows, such that the water is isolated from the refrigerant.

The desired heat transfer is given by the refrigerant's change of state, from liquid to vapor. Since the vaporized refrigerant absorbs minimal heat from a heat transfer fluid or coolant such as water, it is important for effective and efficient heat transfer performance to keep the tube bundle in the evaporator covered, or wetted, with liquid refrigerant during operation. Typically, this is accomplished by operating the evaporator in a "flooded mode" such that the level of biphasic refrigerant in the evaporator is sufficiently high so that the tubes are below the level of liquid refrigerant.

However, in some instances, especially where a VSD is used, it may be difficult to optimize refrigerant quantity in the flow circuit and/or in the evaporator to match both full and partial compressor load operation, since a partial load requires more refrigerant for optimum operation. When operating at the lowest compressor stages, the evaporator becomes oversized in capacity, and will accumulate more liquid refrigerant, which may induce a lack of refrigerant for other components of the circuit (e.g., condenser and liquid line).

What is needed then, is a method and system for operating the vapor compression system at the lowest capacity stages which reduces the volume allocated to biphasic refrigerant in the evaporator, in order to have a better refrigerant quantity adequation when using the same quantity as optimized for full load operation.

BRIEF DESCRIPTION OF THE INVENTION

According to one non-limiting embodiment, a vapor compression system including: a compressor configured to circulate a working fluid and operate at a plurality of operating conditions; an evaporator in fluid communication with the compressor, the evaporator heat exchanger including: a shell configured to allow the working fluid to flow therethrough; a plurality of parallel-spaced tubes disposed within the shell, the plurality of parallel spaced tubes configured to allow a heat transfer fluid to flow therethrough; and at least one baffle operably coupled to the plurality of parallel-spaced tubes, the at least one baffle configured to divide the shell into at least two chambers; an expansion valve assembly in fluid communication with the evaporator; and a control device operably coupled to the compressor and the expansion valve assembly, the control device configured to operate the expansion valve assembly based at least in part on the plurality of operating conditions.

In addition to one or more of the features described above, or as an alternative, in further embodiments, the vapor compression system further including a condenser in fluid communication with the compressor and the expansion valve assembly.

In addition to one or more of the features described above, or as an alternative, in further embodiments, the vapor compression system wherein the at least one baffle comprises a first baffle and a second baffle, wherein the first baffle and the second baffle is configured to divide the shell into a first chamber, a second chamber, and a third chamber.

In addition to one or more of the features described above, or as an alternative, in further embodiments, the vapor compression system wherein the expansion valve assembly comprises: a first valve configured to allow the working fluid to flow into the first chamber; a second valve configured to allow the working fluid to flow into the second chamber; and a third valve configured to allow the working fluid to flow into the third chamber.

In addition to one or more of the features described above, or as an alternative, in further embodiments, the vapor compression system wherein the control device is configured to: operate the compressor at an operating condition; compare the operating condition to a plurality of predetermined conditions; open the first valve when the compressor operating condition is less than or equal to a first predetermined condition; open the first and second valve when the compressor operating condition is greater than the first predetermined condition and less than or equal to a second predetermined condition; and open the first valve, second valve, and third valve when the compressor operating condition is greater than the second predetermined condition.

In addition to one or more of the features described above, or as an alternative, in further embodiments, the vapor compression system wherein the at least one baffle is positioned such that a lower portion of the at least one baffle is operably coupled to a lower portion of the shell, and an upper portion of the at least one baffle extends above the plurality of parallel-spaced tubes and adjacent to an upper portion of the shell.

In addition to one or more of the features described above, or as an alternative, in further embodiments, the vapor compression system wherein the operating condition of the vapor compression system includes at least one of: compressor operating stage capacity, compressor load, working fluid temperature, working fluid pressure, absorbed electrical power, and system efficiency.

According to one non-limiting embodiment, a heat exchanger assembly including: a heat absorption heat exchanger including a shell including at least two inlets, and at least one outlet; a plurality of parallel-spaced tubes disposed within the shell; and at least one baffle operably coupled to the plurality of parallel-spaced tubes, the at least one baffle configured to divide the shell into at least two chambers; wherein each of the at least two inlets is configured to allow a working fluid to flow into each of the at least two chambers, respectively; an expansion valve assembly in fluid communication with the heat absorption heat exchanger, the expansion valve assembly including a conduit operably coupled to each of the at least two inlets, respectively; and a valve operably coupled to each conduit.

In addition to one or more of the features described above, or as an alternative, in further embodiments, the heat exchanger assembly wherein each of the at least one baffle is positioned such that a lower portion of the at least one baffle is operably coupled to a lower portion of the shell, and an upper portion of the at least one baffle extends above the plurality of parallel-spaced tubes and adjacent to an upper portion of the shell.

In addition to one or more of the features described above, or as an alternative, in further embodiments, the heat exchanger assembly wherein each valve is configured to open and close based in part on a compressor operating condition.

In addition to one or more of the features described above, or as an alternative, in further embodiments, the heat exchanger assembly wherein the at least two inlets include at least two working fluid inlets, and at least one heat transfer fluid inlet.

In addition to one or more of the features described above, or as an alternative, in further embodiments, the heat exchanger assembly wherein the at least one outlet includes at least one working fluid outlet, and at least one heat transfer fluid outlet.

In addition to one or more of the features described above, or as an alternative, in further embodiments, the heat exchanger assembly wherein a working fluid is configured to flow through the at least two working fluid inlets into the at least two chambers, and exit through the at least one working fluid outlet; and a heat transfer fluid is configured to flow through the at least one heat transfer fluid inlet into the plurality of parallel-spaced tubes and exit through the at least one heat transfer fluid outlet.

According to one non-limiting embodiment, a method of operating a vapor compression system, the method comprising: operating a control device to operate a compressor to circulate a working fluid; operating the control device to determine an operating condition of the vapor compression system; operating the control device to compare the operating condition of the vapor compression system to a plurality of predetermined conditions; and operating a valve assembly to allow the working fluid to flow into at least one of a plurality of chambers within an evaporator, based at least in part on the operating condition of the compressor.

In addition to one or more of the features described above, or as an alternative, in further embodiments, the method wherein operating the valve assembly includes: opening a first valve when the compressor operating condition is less than or equal to a first predetermined condition; opening the first valve and a second valve when the compressor operating condition is greater than the first predetermined condition and less than or equal to a second predetermined condition; and opening the first valve, the second valve, and a third valve when the compressor operating condition is greater than the second predetermined condition.

In addition to one or more of the features described above, or as an alternative, in further embodiments, the method further including: directing the working fluid through the first valve into a first chamber of the evaporator when the compressor operating condition is less than or equal to a first predetermined condition; directing the working fluid through the first valve into the first chamber of the evaporator and through the second valve into a second chamber of the evaporator when the compressor operating condition is greater than the first predetermined condition and less than or equal to a second predetermined condition; and directing the working fluid through the first valve into the first chamber of the evaporator, through the second valve into the second chamber of the evaporator, and through the third valve into a third chamber of the evaporator when the compressor operating condition is greater than the second predetermined condition.

In addition to one or more of the features described above, or as an alternative, in further embodiments, the method wherein the operating condition of the compressor includes at least one of: compressor operating stage capacity, compressor load, working fluid temperature, working fluid pressure, absorbed electrical power, and system efficiency.

In addition to one or more of the features described above, or as an alternative, in further embodiments, the method wherein the working fluid is refrigerant.

BRIEF DESCRIPTION OF THE DRAWINGS

The accompanying drawings form a part of the specification. Throughout the drawings, like reference numbers identify like elements.

Figure 1:
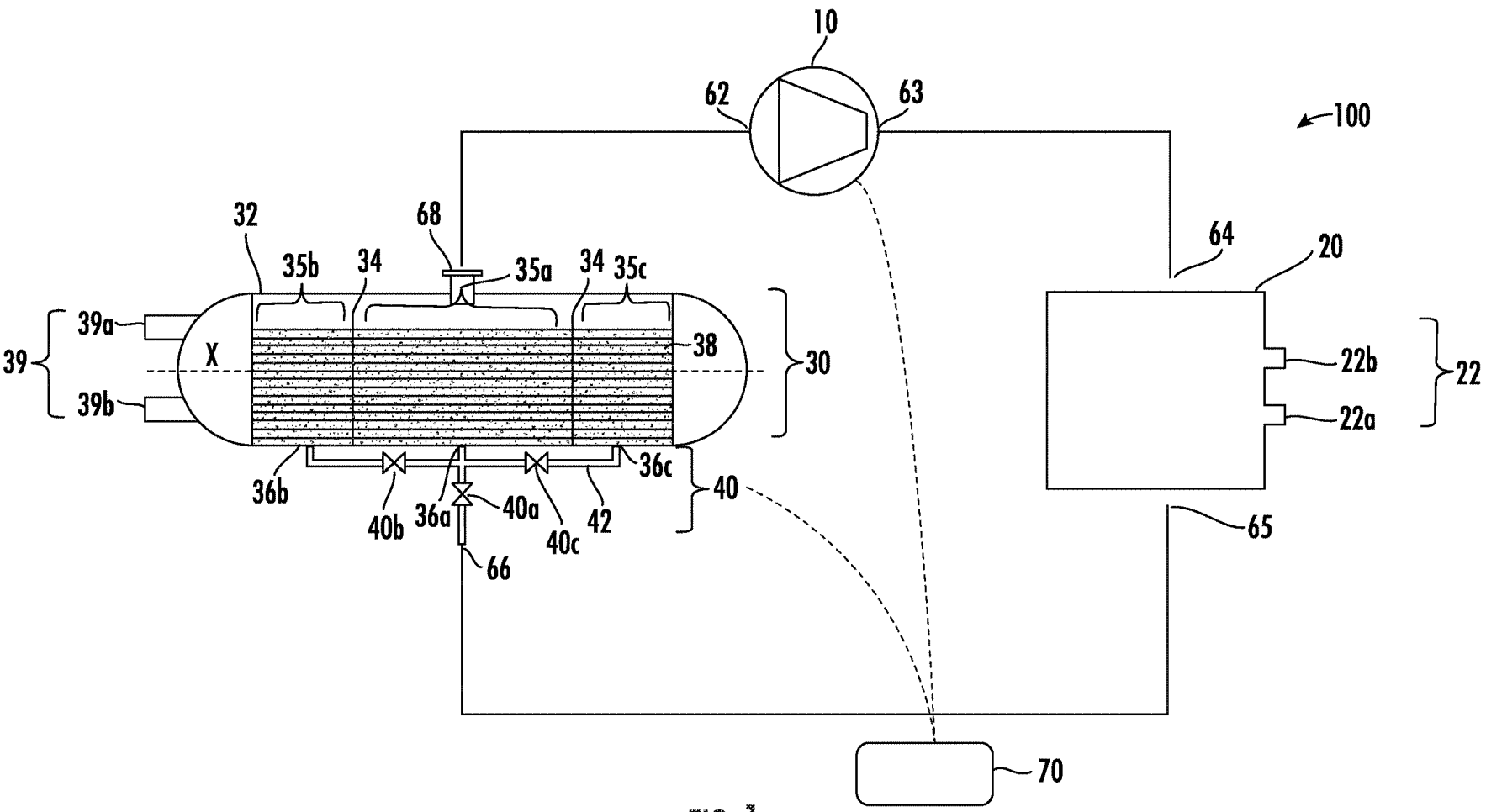
FIG. 1 illustrates a vapor compression system in accordance with embodiments of the disclosure.

These and other advantages and features will become more apparent from the following description taken in conjunction with the drawings.

DETAILED DESCRIPTION OF THE INVENTION

A detailed description of one or more embodiments of the disclosed apparatus and method are presented herein by way of example and not limitation with reference to the Figures. As described below, a system and method for operating a vapor compression system 100 having a heat absorption heat exchanger (e.g., evaporator 30) configured with an internal baffle system 34 and adjacent expansion valve assembly 40, to operate at variable (including low) compressor loads is disclosed, which allows for a reduced heat transfer surface within the evaporator 30 while improving system equivalence of refrigerant quantity and provide overall higher system efficiency.

FIG. 1 illustrates a vapor compression system 100 in accordance with embodiments of the disclosure. The vapor compression system 100 may include many other conventional features not depicted for simplicity of the drawings. Vapor compression system 100 is directed to refrigeration systems and may include chiller systems, and systems having a multiple stage compressor arrangement. Persons of ordinary skill in this art will readily understand that embodiments and features of this invention are contemplated to include and apply to, not only single stage compressor/chillers, but also to multistage compression chillers. As shown, vapor compression system 100 includes a compressor 10, a heat rejection heat exchanger (hereafter, "condenser") 20, an expansion valve assembly 40, and a heat absorption heat exchanger (hereafter, "evaporator") 30, and which are serially connected to form a semi- or fully-hermetic, closed-loop refrigeration system.

Figure 2:
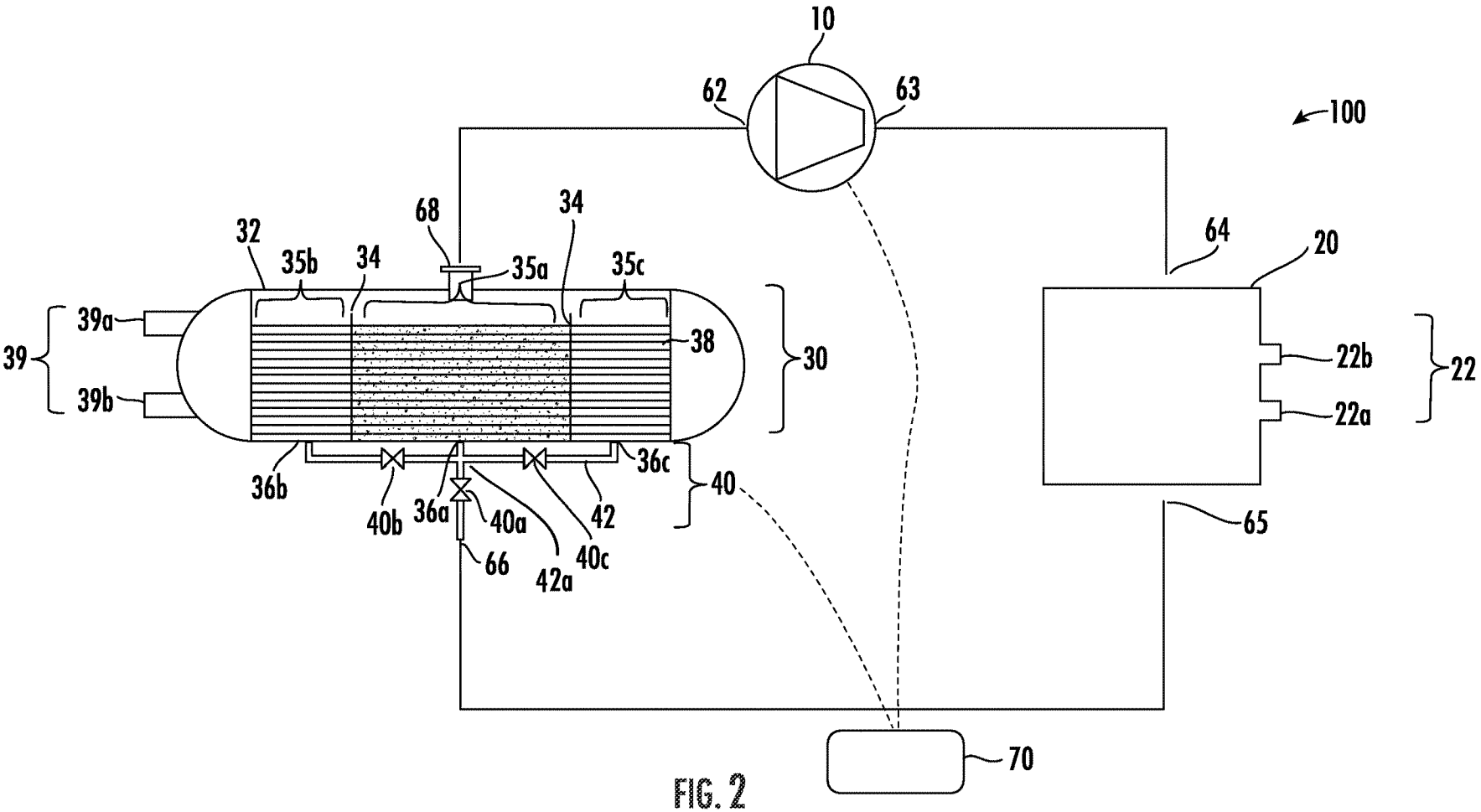
FIG. 2 illustrates a vapor compression system in accordance with embodiments of the disclosure.

In the depicted embodiments, evaporator 30 may be a type of flooded evaporator such as the shell-and-tube flooded evaporator illustrated in FIG. 1 and FIG. 2. Evaporator 30 may be implemented in various configurations of an HVAC or refrigeration system, and may be embodied within a chiller unit, which may be implemented in such systems. However, it will be appreciated that the disclosed embodiments can be applied to various other heat exchangers, which may be employed in countless configurations of an HVAC and/or refrigeration system.

Vapor compression system 100 may circulate a working fluid to control the temperature in a space such as a room, home, or building. The working fluid may be circulated to absorb and remove heat from the space and may subsequently reject the heat elsewhere. The working fluid may be a refrigerant or a mixture of refrigerant and a non-refrigerant (e.g., oil) or a blend thereof in gas, liquid or multiple phases (hereafter, "refrigerant").

An exemplary compressor 10 may be a screw compressor having a motor (not shown) with the capability to operate at varying speeds (e.g., VSD capability) and thus, the ability to operate under varying load conditions. Alternative compressors 10 may include screw compressors with slide-valve capacity adjustment, centrifugal compressors, scroll compressors, or reciprocating compressors. The compressor 10 may also include a single stage and/or multistage compressor. Compressor 10 has a suction inlet port 62 and a discharge port 63. In operation, the compressor 10 compresses the refrigerant to drive a recirculating flow of refrigerant through the vapor compression system 100.

Condenser 20, in fluid communication with compressor 10, receives vapor refrigerant through inlet port 64. The condenser 20 removes heat from the refrigerant and transfers heat to a heat transfer fluid (e.g., water, air or a fluid mixture) running through the condenser 20 in a separate system 22. For example, water returning from a cooling tower (not shown) enters the condenser 20 via inlet port 22*a* at a typical temperature of 27° C. After heat exchange occurs, the water is discharged from the condenser 20 via outlet port 22*b* at a typical temperature of 32° C. During the heat exchange process, the refrigerant undergoes a phase change from a vapor to a liquid, and flows as a high pressure liquid through outlet port 65. The condenser 20 may include a float valve (not shown) which acts as an expansion device. Alternative implementations may include alternate expansion devices.

Downstream from condenser 20, is evaporator 30, which receives biphasic refrigerant through an expansion valve assembly 40 disposed between the condenser 20 and evaporator 30. FIG. 1 and FIG. 2 show embodiments of evaporator 30 that further detail exemplary arrangements and orientation of the evaporator 30 and expansion valve assembly 40. It will be appreciated that evaporator 30 is a simplified illustration and does not show end plates, tube sheets, oil return line and other usual components that may be used in typical evaporators. In a cooling cycle, water is chilled in evaporator 30 to a typical temperature of 6° C. and is discharged from evaporator 30 via outlet port 39*a*. The chilled water is typically distributed throughout the space or spaces to be cooled using, for example, one or more air handling units. The chilled water absorbs heat from the spaces to be cooled, and returns to evaporator 30 via inlet 39*b* at a typical temperature of 12° C., where the chilled water cycle may be repeated. The refrigerant receives heat from the returning water, causing some of the refrigerant to undergo a phase change (from liquid to vapor) permitting vapor to flow through outlet port 68 and to suction inlet 62 of compressor 10.

Referring to FIG. 1, in one non-limiting embodiment, evaporator 30 includes a shell 32, a baffle system 34 having one or more baffles forming at least two or more chambers (e.g., 35*a*, 35*b*, 35*c*) discussed below, each chamber in fluid communication with a respective inlet port (e.g., 36*a*, 36*b*, 36*c*), and evaporator 30 further including a tube bundle 38 disposed therein.

The shell 32, in general, is a cylindrical shaped container but may have any shape. The shell 32 has disposed therein tube bundle 38 running longitudinally along the length of the shell 32. The tube bundle 38 includes a plurality of tubes through which a heat transfer fluid (e.g., water or fluid mixture or air) may flow in another closed loop system 39 as discussed below. The shell 32 also includes one or more inlet ports, e.g., 36*a*, 36*b*, 36*c*, operably coupled to the expansion valve assembly 40 described below, which permits biphasic refrigerant to enter one or more chambers 35*a*, 35*b*, 35*c* of evaporator 30.

Baffle system 34 may include one or more baffles that divide the shell 32 into two or more chambers e.g., 35*a*, 35*b*, 35*c*. Each baffle is generally perpendicular (e.g., 90 degrees) to an X-axis that passes longitudinally through shell 32. A baffle has a lower portion and an upper portion. The lower portion of the baffle is operably coupled to a lower portion of shell 32, forming a seal between the lower portion of the baffle and adjacent chambers (e.g., between chambers 35*a* and 35*b*). The plurality of tubes of tube bundle 38, may pass through the baffle in a tight contact to inhibit the flow of liquid refrigerant from one chamber to an adjacent chamber. The upper end of each baffle extends to a point in the shell 32 that is generally above the tube bundle 38. The upper end of each baffle is not affixed to the shell 32, thereby forming one or more chambers 35*a*, 35*b*, 35*c* that permit any vapor that may form during the heat exchange process, to flow through outlet port 68. Liquid refrigerant will remain in a chamber until it evaporates in contact with the tubes of tube bundle 38.

It may be appreciated that the baffle system 34 may have a single baffle forming two chambers, or a plurality of baffles 34(n) forming a plurality of chambers 35(n+1). The number (n) of baffles may be determined by a variety of factors, including the capacity of the vapor compression system 100, the compressor 10, the shell 32, and operational metrics such as compressor speed and load, temperature and pressure of the refrigerant as it circulates through the vapor compression system 100, as well as volume optimization and manufacturing costs.

A baffle may be manufactured from a rigid material, such as a metal or metal-alloy, or a semi-rigid or flexible material, such as a plastic. The baffle may be substantially planar, having a generally flat surface with a plurality of orifices or openings (not shown) for receiving the plurality of tubes from tube bundle 38. In some embodiments, when a tube from tube bundle 38 is positioned in an orifice, a complete or partial seal may form between the tube and the orifice, for inhibiting the flow of refrigerant from one side of the baffle to an opposing side of the baffle. In the case of a partial seal, some refrigerant may leak through the orifice from one chamber to an adjacent chamber. By way of example, referring to FIG. 2, chamber 35*a* contains liquid refrigerant shown, in part, by the plurality of "dots" through this portion of the illustration. Chamber 35*b* will contain vapor refrigerant and may contain a minimal quantity of liquid refrigerant, depicted by the absence of "dots," and illustrating only tube bundle 38. If liquid refrigerant leaks from chamber 35*a* to 35*b*, the refrigerant in chamber 35*b* will evaporate over time, but especially when the refrigerant contacts dry portions of the tube bundle, thereby minimizing the accumulation of refrigerant in chamber 35*b*.

In one non-limiting embodiment, expansion valve assembly 40 may be adjacent to evaporator 30, as illustrated in FIG. 1 and FIG. 2. Expansion valve assembly 40 may include a first valve (e.g., 40*a*) for directing the flow of refrigerant to at least a first chamber (e.g., 35*a*) through an inlet port 36*a*. The first valve 40*a* may include an expansion valve for de-pressurizing the refrigerant. The expansion valve assembly 40 may include a second valve (e.g., 40*b*) positioned along a conduit 42, between the first valve 40*a* and an inlet port 36*b*, for directing the flow of liquid refrigerant to a second chamber (e.g., 35*b*). The expansion valve assembly 40 may include a third valve (e.g., 40*c*) positioned along a conduit 42 between the first valve 40*a* and an inlet port 36*c*, for directing the flow of liquid refrigerant to a third chamber (e.g., 35*b*). In some embodiments, at least one of a second valve (e.g., 40*b*) and a third valve (e.g., 40*c*) may be selected from a group consisting of an expansion valve or a solenoid valve. It may be appreciated that the expansion valve assembly 40 may have as many (n) number of valves for directing liquid refrigerant into an equal number (n) of chambers e.g., 35*n*. As discussed above, the number (n) of valves may be dependent on the same factors as the number of chambers.

In one non-limiting embodiment, the second valve 40*b* and the third valve 40*c* may be serially connected along conduit 42 with the first valve 40*a* positioned downstream from conduit 42 as illustrated in FIG. 1. In another non-limiting embodiment, all valves (e.g., 40*a*, 40*b*, 40*c*) may be connected in parallel along conduit 42, with valve 40*c* positioned for example, at junction 42*a*. In this configuration, the valves 40*a*, 40*b*, 40*c* may include adjustable opening type of expansion valves. In some embodiments, valve 40*a* remains open at all times during compressor operation, but may open to varying degrees. For example, if valve 40*a* is an expansion valve, the opening may be adjustable depending on operating conditions.

In some embodiments, the expansion valve assembly 40 may include a control device (e.g., microprocessor based) 70, having a memory and a processor coupled to the memory. The control device 70 may be configured to operate the compressor 10 at a plurality of variable speeds based at least in part, on the determined output of the compressor 10.

The control device 70 may also be configured to receive input signals from various sensors, for controlling vapor compression system 100 and/or expansion valve assembly 40. For example, control device 70 may be in communication with at least one valve (e.g., 40*a*) of expansion valve assembly 40 and compressor 10. In one non-limiting embodiment, control device 70 may be configured to operate the expansion valve assembly 40 (e.g., valves 40*a*, 40*b*, 40*c*) based in part, on a plurality of predetermined operating conditions, which may include upper and/or lower limits and/or ranges. In one non-limiting embodiment, the control device 70 may be configured to store at least one predetermined operating condition or range having at least one upper limit and at least one lower limit for determining when to open, close (or partially open/close) and/or adjust at least two or more valves (e.g., 40*a*, 40*b*, 40*c*). In another non-limiting embodiment, the control device 70 may be configured to store a range of operating condition limits in which a plurality of inputs selected from a plurality of operating conditions may be used to dynamically determine when to open, close or adjust at least two or more valves. An operating condition may include compressor operating stage capacity, the temperature and/or the pressure of the refrigerant at different locations throughout the refrigerant cycle, absorbed electrical power, system efficiency.

Turning to FIG. 2, a vapor compression system 100 in accordance with embodiments of the disclosure is shown. In FIG. 2, evaporator 30 is the same in all material respects as FIG. 1, and illustrates the condition of evaporator 30 when valves 40*b*, 40*c* are closed. In this example, biphasic refrigerant is permitted to flow to one chamber, e.g., 35*a* through a first valve (e.g., 40*a*). As illustrated in FIG. 2, the "dots" in chamber 35*a* represent the presence of biphasic refrigerant, while the absence of "dots in chambers 35*b*, 35*c*, represent the absence (or a minimal quantity) of liquid refrigerant.

Refrigerant in the chamber 35*a* will be in heat exchange relation with the water flowing through that portion of the tube bundle 38 passing through chamber 35*a*. In contrast, since valves 40*b* and 40*c* are closed in this example, the level of liquid refrigerant in chambers 40*b* and/or 40*c*, is below all of tube bundle 38. As a result, the volume around and above the tube bundle 38 in chambers 35*b*, 35*c*, will be occupied by vapor refrigerant which may flow through outlet port 68, or remain mostly static since there is no forced circulation in those chambers. In this example, valves 40*b*, 40*c* remain closed until the control device 70 receives a signal indicating a change in a predetermined operating condition. For example, the control device 70 may be configured to actuate (open) valves 40*b* and/or 40*c*, depending on a change of condenser load capacity, such as when it changes from low, to mid-range or to a high load capacity. It should be appreciated that that the control device 70 may be configured to open and/or close or partially open or close a valve 40*a*, 40*b*, 40*c* at varying rates, and/or under varying conditions. It should also be appreciated that various combinations of opening and closing valves under a range of operating conditions are possible, as are the number of combinations of when and to what capacity, a chamber may be filled, in whole or in part, with bi-phasic refrigerant.

Figure 3:
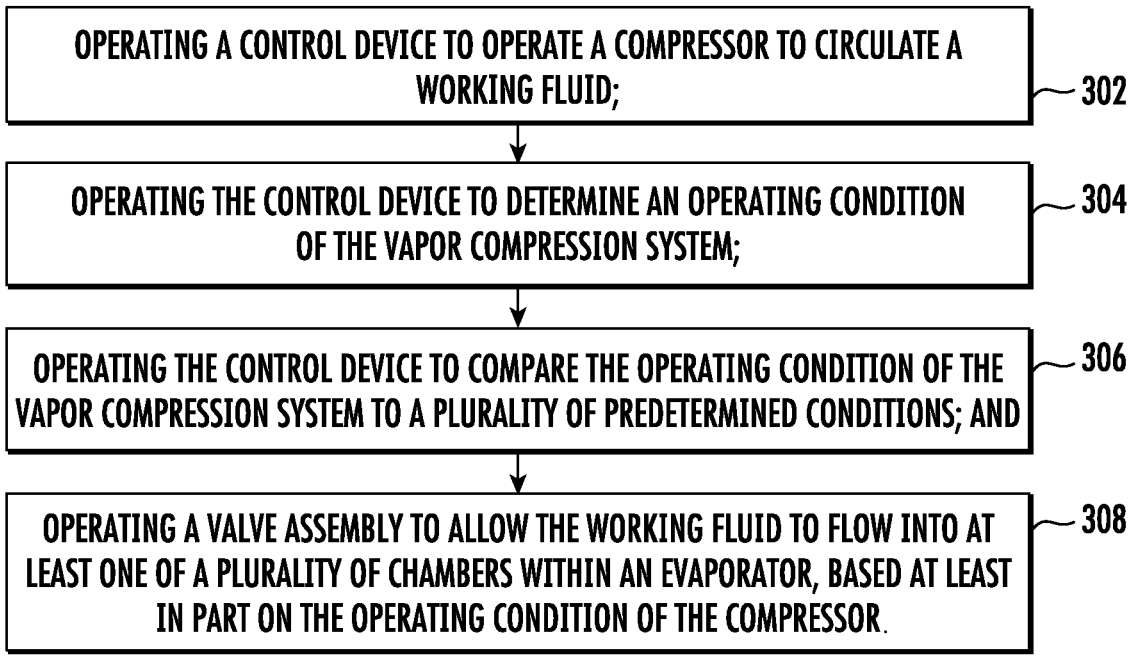
FIG. 3 discloses a method for operating a vapor compression system in accordance with embodiments of the disclosure.

Referring to FIG. 3, a method of controlling a vapor compression system having a compressor 10, a heat absorption heat exchanger (e.g., evaporator) 30 operably coupled to an expansion valve assembly 40, and each of the compressor 10 and the expansion valve assembly 40, in communication with a control device 70 is shown, in accordance with the embodiments of the disclosure.

In an operational vapor compression system 100, a compressor 10 directs a working fluid (hereafter, "refrigerant), in a vapor phase through a heat rejection heat exchanger such as condenser 20, through an expansion valve assembly 40 and to an evaporator 30, before returning to the compressor 10 to complete the refrigerant cycle. The compressor 10 may include a screw compressor. Alternative compressors 10 may include centrifugal compressors, scroll compressors, or reciprocating compressors. The compressor 10 may also include a single stage and/or multistage compressor chiller. Compressor 10 may be configured to operate at variable speeds and loads. For example, the compressor 10 may having a motor (not shown) with the capability to operate at varying speeds (e.g., VSD capability) and thus, the ability to operate under varying load conditions.

Evaporator 30 may be a type of flooded evaporator such as a shell-and-tube evaporator as illustrated in FIG. 1, further having one or more baffles forming at least two or more chambers (e.g., 35*a*, 35*b*, 35*c*), each chamber in fluid communication with a respective inlet port (e.g., 36*a*, 36*b*, 36*c*). Evaporator 30 further includes a tube bundle 38 disposed therein. The one or more inlet ports, e.g., 36*a*, 36*b*, 36*c*, are operably coupled to the expansion valve assembly 40 described below, which permits biphasic refrigerant to enter one or more chambers 35*a*, 35*b*, 35*c* of evaporator 30.

Expansion valve assembly 40 may include a first valve (e.g., 40*a*) for directing the flow of refrigerant to at least a first chamber (e.g., 35*a*) through an inlet port 36*a*. The first valve 40*a* may include an expansion valve for de-pressurizing the refrigerant. The expansion valve assembly 40 may include a second valve (e.g., 40*b*) between the first valve 40*a* and an inlet port 36*b*, for directing the flow of liquid refrigerant to a second chamber (e.g., 35*b*). The expansion valve assembly 40 may include a third valve (e.g., 40*c*) between the first valve 40*a* and an inlet port 36*c*, for directing the flow of liquid refrigerant to a third chamber (e.g., 35*c*).

The vapor compression system 100 may include a control device 70 in communication with the compressor 10 and expansion valve assembly 40. The control device (e.g., microprocessor based) 70, having a memory and a processor coupled to the memory, may be configured to receive a plurality of input signals from various sensors representing a plurality of operating conditions for controlling the vapor compression system 100 and/or the expansion valve assembly 40.

As more fully described below, in one non-limiting embodiment, the control device 70 may be configured to have stored in memory, a plurality of predetermined operating conditions which may include an upper and/or lower limit or range, that may be used to operate the expansion valve assembly 40. In another non-limiting embodiment, the control device 70 may be configured to receive a plurality of input signals representing a plurality of operating conditions, and from such input, dynamically control the operation of the expansion valve assembly 40 to achieve overall improved vapor compression system 100 operation.

In general, the method uses the control device 70 to open, close (partially open or close) and/or adjust, at least two or more valves, e.g., 40*a*, 40*b*, 40*c* to permit biphasic refrigerant to flow into one or more chambers of evaporator 30, in response to signals from the compressor 10 or other components of the vapor compression system 100. It should be appreciated that various combinations of opening and closing valves under a range of operating conditions are possible, as are the number of combinations of when and to what capacity, a chamber may be filled, in whole or in part, with refrigerant. Since a plurality of inputs to control device 70 may be used to determine the operation of the expansion valve assembly 40, various methods may be used to achieve the same result, that of allowing refrigerant to flow through the expansion valve assembly 40, into one or more chambers of the evaporator.

The method begins at step 302 with operating a control device 70 to operate a compressor 10 to circulate a working fluid (e.g., refrigerant). Step 302 of the method includes operating a control device 70 to determine an operating condition of the vapor compression system 100, such as compressor 10. An operating condition may include compressor operating stage capacity, compressor load, the temperature and/or the pressure of the refrigerant at various locations in the refrigerant cycle, absorbed electrical power, system efficiency.

In step 306, the method includes operating the control device 70 to compare an operating condition to a plurality of predetermined operating condition. For example, the control device 70 may compare an operating condition of compressor 10, such as load capacity, to a plurality of predetermined operating condition limits, which may also include compressor load capacity, but may also include other predetermined operating condition limits as discussed above.

Step 308 of the method includes operating an expansion valve assembly 40 to allow the working fluid to flow into at least one of a plurality of chambers within an evaporator 30, based at least in part, on the operating condition of the compressor 10.

In general, the control device 70 determines whether an operating condition should result in an action, e.g., opening, closing, adjusting, etc., a valve based in part, on comparing a vapor compression operating condition (e.g., a compressor operating condition) to a plurality of predetermined operating condition limits or ranges.

In one non-limiting embodiment, operating the expansion valve assembly 40, includes opening a first valve when the compressor operating condition is less than or equal to a first predetermined operating condition. By way of example, a first predetermined operating condition may be when the compressor operating load is equal to or less than 25% of maximum operating load capacity. In this example, the method may include directing refrigerant through the first valve 40*a*, into a first chamber 35*a* of the evaporator 30.

In another non-limiting embodiment, the method may include opening the first valve 40*a* and a second valve 40*b*, when the compressor operating condition is greater than the first predetermined condition and less than or equal to a second predetermined condition. By way of example, the compressor operating condition may be greater than 25% of the maximum operating load capacity, but less than or equal to 35% of the maximum compressor operating load capacity. In this example, the method may include directing the refrigerant through the first valve 40*a* into the first chamber 35*a*, and through the second valve 40*b* and into the second chamber 35*b* of the evaporator 30.

In yet another non-limiting embodiment, the method may include opening the first valve 40*a*, the second valve 40*b* and the third valve 40*c*, when the compressor operating condition is greater than the second predetermined condition. In this example, when the compressor operating load is greater than 35% of the maximum operating load capacity, the method may include directing the working fluid through the first valve 40*a* into the first chamber 35*a*, through the second valve 40*b* and into the second chamber 35*b*, and through the third valve 40*c* and into the third chamber 35*c*, of the evaporator 30.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

I claim:

1. A vapor compression system comprising:

a compressor configured to circulate a working fluid and operate at a plurality of operating conditions;

an evaporator in fluid communication with the compressor, the evaporator comprising:

a shell configured to allow the working fluid to flow therethrough and including at least two inlets, and at least one outlet;

a plurality of parallel-spaced tubes disposed within the shell, the plurality of parallel spaced tubes configured to allow a heat transfer fluid to flow therethrough; and at least one baffle operably coupled to the plurality of parallel-spaced tubes, the at least one baffle configured to divide the shell into at least two chambers;

an expansion valve assembly in fluid communication with the evaporator the expansion valve assembly comprising:

a conduit operably coupled to each of the at least two inlets, respectively; and a valve operably coupled to each conduit; and a control device operably coupled to the compressor and the expansion valve assembly, the control device configured to operate the expansion valve assembly based at least in part on the plurality of operating conditions.

2. The system of claim 1, further comprising a condenser in fluid communication with the compressor and the expansion valve assembly.

3. The system of claim 1, wherein the at least one baffle comprises a first baffle and a second baffle, wherein the first baffle and the second baffle is configured to divide the shell into a first chamber, a second chamber, and a third chamber.

4. The system of claim 3, wherein the expansion valve assembly comprises:

a first valve configured to allow the working fluid to flow into the first chamber;

a second valve configured to allow the working fluid to flow into the second chamber; and a third valve configured to allow the working fluid to flow into the third chamber.

5. The system of claim 4, wherein the control device is configured to:

operate the compressor at an operating condition;

compare the operating condition to a plurality of predetermined conditions;

open the first valve when the compressor operating condition is less than or equal to a first predetermined condition;

open the first and second valve when the compressor operating condition is greater than the first predetermined condition and less than or equal to a second predetermined condition; and open the first valve, second valve, and third valve when the compressor operating condition is greater than the second predetermined condition.

6. The system of claim 1, wherein each of the at least one baffle is positioned such that a lower portion of the at least one baffle is operably coupled to a lower portion of the shell, and an upper portion of the at least one baffle extends above the plurality of parallel-spaced tubes and adjacent to an upper portion of the shell.

7. The system of claim 1, wherein the operating condition of the vapor compression system comprises at least one of: compressor operating stage capacity, compressor load, working fluid temperature, working fluid pressure, absorbed electrical power, and system efficiency.

8. A heat exchanger assembly comprising:

a heat absorption heat exchanger comprising:

a shell including at least two inlets, and at least one outlet;

a plurality of parallel-spaced tubes disposed within the shell; and at least one baffle operably coupled to the plurality of parallel-spaced tubes, the at least one baffle configured to divide the shell into at least two chambers;

wherein each of the at least two inlets is configured to allow a working fluid to flow into each of the at least two chambers, respectively.

an expansion valve assembly in fluid communication with the heat absorption heat exchanger, the expansion valve assembly comprising:

a conduit operably coupled to each of the at least two inlets, respectively; and a valve operably coupled to each conduit.

9. The heat exchanger assembly of claim 8, wherein each of the at least one baffle is positioned such that a lower portion of the at least one baffle is operably coupled to a lower portion of the shell, and an upper portion of the at least one baffle extends above the plurality of parallel-spaced tubes and adjacent to an upper portion of the shell.

10. The heat exchanger assembly of claim 8, wherein each valve is configured to open and close based in part on a compressor operating condition.

11. The heat exchanger assembly of claim 8, wherein the at least two inlets comprises at least two working fluid inlets, and at least one heat transfer fluid inlet.

12. The heat exchanger assembly of claim 11, wherein the at least one outlet comprises at least one working fluid outlet, and at least one heat transfer fluid outlet.

13. The heat exchanger assembly of claim 12, wherein a working fluid is configured to flow through the at least two working fluid inlets into the at least two chambers, and exit through the at least one working fluid outlet; and a heat transfer fluid is configured to flow through the at least one heat transfer fluid inlet into the plurality of parallel-spaced tubes and exit through the at least one heat transfer fluid outlet.

14. A method of operating a vapor compression system, the method comprising:

operating a control device to operate a compressor to circulate a working fluid;

operating the control device to determine an operating condition of the vapor compression system;

operating the control device to compare the operating condition of the vapor compression system to a plurality of predetermined conditions; and operating a valve assembly to allow the working fluid to flow into at least one of a plurality of chambers within an evaporator, based at least in part on the operating condition of the compressor wherein the evaporator comprises a shell configured to allow the working fluid to flow therethrough and including at least two inlets, and at least one outlet and the valve assembly comprises:

a conduit operably coupled to each of the at least two inlets, respectively; and a valve operably coupled to each conduit and operating the valve assembly comprises operating the at least two valves.

15. The method of claim 14, wherein operating the valve assembly comprises:

opening a first valve when the compressor operating condition is less than or equal to a first predetermined condition;

opening the first valve and a second valve when the compressor operating condition is greater than the first predetermined condition and less than or equal to a second predetermined condition; and opening the first valve, the second valve, and a third valve when the compressor operating condition is greater than the second predetermined condition.

16. The method of claim 15, further comprising:

directing the working fluid through the first valve into a first chamber of the evaporator when the compressor operating condition is less than or equal to a first predetermined condition;

directing the working fluid through the first valve into the first chamber of the evaporator and through the second valve into the second chamber of the evaporator when the compressor operating condition is greater than the first predetermined condition and less than or equal to a second predetermined condition; and directing the working fluid through the first valve into the first chamber of the evaporator, through the second valve into a second chamber of the evaporator, and through the third valve into a third chamber of the evaporator when the compressor operating condition is greater than the second predetermined condition.

17. The method of claim 14, wherein the operating condition of the compressor comprises at least one of: compressor operating stage capacity, compressor load, working fluid temperature, working fluid pressure, absorbed electrical power, and system efficiency.

18. The method of claim 14, wherein the working fluid is refrigerant.

* * * * *